US011272742B2

(12) United States Patent
Santos

(10) Patent No.: US 11,272,742 B2
(45) Date of Patent: Mar. 15, 2022

(54) NECTAR COLLECTOR HAVING A STRAW THAT GUIDES A FLOW OF VAPOR PRODUCTS AROUND A POWER SOURCE

(71) Applicant: Rodrigo Escorcio Santos, Rockville, MD (US)

(72) Inventor: Rodrigo Escorcio Santos, Rockville, MD (US)

( * ) Notice: Subject to any disclaimer, the term of this patent is extended or adjusted under 35 U.S.C. 154(b) by 0 days.

(21) Appl. No.: 17/479,113

(22) Filed: Sep. 20, 2021

(65) Prior Publication Data

US 2022/0039477 A1 Feb. 10, 2022

Related U.S. Application Data

(63) Continuation of application No. 17/398,300, filed on Aug. 10, 2021.

(60) Provisional application No. 63/063,552, filed on Aug. 10, 2020.

(51) Int. Cl.

| | |
|---|---|
| ***A24F 40/485*** | (2020.01) |
| ***A24F 40/10*** | (2020.01) |
| ***A24F 40/46*** | (2020.01) |

(52) U.S. Cl.

CPC ..... *A24F 40/485* (2020.01); *A24F 40/10* (2020.01); *A24F 40/46* (2020.01)

(58) Field of Classification Search

CPC ..... A24F 40/485; A24F 40/46; A24F 40/10; A24F 40/40

See application file for complete search history.

(56) References Cited

U.S. PATENT DOCUMENTS

| | | | | |
|---|---|---|---|---|
| 4,945,928 | A | 8/1990 | Rose | |
| 9,661,878 | B2 | 5/2017 | Liu | |
| 9,986,764 | B2 * | 6/2018 | Watson | A24F 40/485 |
| 10,159,285 | B2 | 12/2018 | Watson | |
| 2013/0152922 | A1 | 6/2013 | Benassayag | |
| 2014/0041655 | A1 | 2/2014 | Barron | |
| 2015/0040926 | A1 | 2/2015 | Saydar | |
| 2015/0128976 | A1 | 5/2015 | Verleur | |
| 2015/0136155 | A1 | 5/2015 | Verleur | |
| 2015/0150305 | A1 | 6/2015 | Shenkal | |
| 2015/0296889 | A1 | 10/2015 | Liu | |
| 2016/0001925 | A1 | 1/2016 | Frazier | |
| 2016/0235121 | A1 | 8/2016 | Rogan | |
| 2016/0286865 | A1 | 10/2016 | King | |
| 2016/0353800 | A1 * | 12/2016 | Di Carlo | A24F 40/60 |
| 2016/0366947 | A1 | 12/2016 | Monsees | |
| 2016/0374399 | A1 | 12/2016 | Monsees | |
| 2017/0231279 | A1 * | 8/2017 | Watson | H01M 50/213 131/329 |
| 2017/0295845 | A1 | 10/2017 | Bajpai | |
| 2018/0014574 | A1 | 1/2018 | Rogan | |
| 2018/0098571 | A1 * | 4/2018 | Watson | A24F 40/46 |

(Continued)

*Primary Examiner* — Hae Moon Hyeon

(74) *Attorney, Agent, or Firm* — Edell, Shapiro & Finnan, LLC

(57) ABSTRACT

A system and method for vaporizing a consumable is disclosed. The system includes a straw and a heating element configured to be connected to a desired power source type (e.g., vape pen, dab pen, battery, vape battery etc.) The heating element is configured to heat and vaporize a consumable. During use, the vapor from the heated consumable is syphoned through the straw and the straw guides a flow of vapor to avoid the power source.

17 Claims, 6 Drawing Sheets

(56) References Cited

U.S. PATENT DOCUMENTS

| | | | |
|---|---|---|---|
| 2018/0146715 | A1 | 5/2018 | Takeuchi |
| 2018/0255831 | A1 | 9/2018 | Lipowicz |

* cited by examiner

NECTAR COLLECTOR HAVING A STRAW THAT GUIDES A FLOW OF VAPOR PRODUCTS AROUND A POWER SOURCE

CROSS-REFERENCE TO RELATED APPLICATIONS

This application is a continuation of U.S. application Ser. No. 17/398,300, filed Aug. 10, 2021, which claims priority to U.S. Provisional Application No. 63/063,552, filed Aug. 10, 2020. The entirety of each of these applications is incorporated herein by reference.

FIELD OF INVENTION

The present invention relates to the field of a vaporization device and, in particular, a nectar collector including a straw, either alone or with a heating element connected thereto, that guides a flow of vapor products around a power source.

BACKGROUND

In view of developments in technology and the law, vaporization devices and nectar collectors have become quite popular. Often, to function, a vaporization device heats a consumable and/or inhalable product such as an oil, a wax, a concentrate, or a combustible plant substance to create a vapor for a user to inhale. Heating liquid or wax consumables has become particularly popular since liquids and waxes may be more concentrated and/or specialized as compared to plant substances and because a quantity of wax or liquid may last longer than a similar quantity of plant substance.

In typical nectar collectors, a tip of a straw is dipped in a consumable (e.g., oil, wax, a concentrate, a combustible plant substance, etc.) and is heated. The heat causes the consumable to vaporize into a vaporization product. The vapor (e.g., vaporization product) may be drawn through a trunk, or main body, of the nectar collector before exiting an outlet. The trunk may house a power source, e.g., battery, but vaporization products may condense as they pass through the trunk of the nectar collector causing a buildup of vapor products and/or contaminates inside the trunk and/or on the power source. Over time, this may negatively affect the operation of the nectar collector. For example, the buildup of vapor product may clog the trunk of the nectar collector, preventing a flow of fluid therethrough. Further, the trunk and/or the power source may corrode from contact with the buildup of vapor product and/or air. Thus, the useful life of power source may be reduced.

In view of at least the aforementioned issues, a vaporization device having a straw that overcomes the above noted issues is desirable.

SUMMARY

The present invention relates to a vaporization device that improves the life of a power source powering the vaporization device by preventing a flow of fluid from passing through a main body of the power source.

According to an example embodiment, a vaporization device includes a heating element that is coupleable to a power source, and a straw having an inlet fluidly coupled to an outlet via a tube. The inlet is configured to partially encapsulate the heating element and the tube is configured to extend alongside the power source to which the heating element is coupled. Thus, when the heating element heats a vaporizable substance, vapor generated by the heating element flows through the tube to the outlet alongside an outer surface the power source.

In at least one form of the device, the heating element comprises a coil and a portion of the inlet is substantially concentric with a circumference of the coil. In some instances, the heating element may also include a rod extending from the coil and at least a portion of the rod may extend through an inlet port of the inlet. Additionally or alternatively, the heating element may further include a base configured to couple the heating element to a coupling head of a power source. The inlet and the tube may be configured to guide a flow of fluid around the coil and the power source.

In at least one form of the device, the inlet comprises an annular, cylindrical portion. Additionally or alternatively, the inlet may comprise a frustoconical portion with an inlet port. In frustoconical embodiments, the heating element may comprise a rod extending from a coil, the inlet may be concentric with a portion of the rod, and the inlet port and the portion of the rod may define a radial gap for guiding the vaporizable substance into the inlet.

In at least one form of the device, the tube comprises a concave lateral surface configured to conform to and contact the outer surface of the power source. Additionally or alternatively, the straw may include a connector duct that extends perpendicularly to the tube to fluidly couple the inlet to the tube.

According to another example embodiment, a system includes a power source, a heating element that is coupleable to the power source to receive power from the power source, and a straw having an inlet fluidly coupled to an outlet via a tube. The inlet is configured to partially encapsulate the heating element and the tube is configured to extend alongside the power source when coupled thereto so that when the heating element heats a vaporizable substance, vapor generated by the heating element flows through the tube to the outlet alongside an outer surface the power source. The heating element and straw may include any features and advantages of the device discussed above.

In yet another example embodiment, a method includes heating a consumable via a heating element, syphoning vaporization products of the consumable into an inlet of a straw, guiding, via a tube of the straw, the vaporization products around a main body of a power source electrically coupled to the heating element, and guiding the vaporization products through an outlet of the straw.

In at least one form of the method, heating the consumable comprises contacting the consumable with a heating coil included in the heating element. Additionally or alternatively, heating the consumable may include contacting the consumable with a heated outer surface of the heating element. Heating the heating coil and/or the outer surface may include transmitting electricity from the power source to the heating coil via a base extending from the heating coil. Still further, in some instances, the method may also include guiding the vaporization products from the inlet to the tube via a connector duct that extends perpendicularly to the tube.

BRIEF DESCRIPTION OF THE DRAWINGS

To complete the description and in order to provide for a better understanding of the present invention, a set of drawings is provided. The drawings form an integral part of the description and illustrate an embodiment of the present invention, which should not be interpreted as restricting the scope of the invention, but just as an example of how the invention can be carried out. The drawings comprise the following figures.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

The increased popularity in vaping, dabbing and other vaporization products has led to common sizing of couplings between consumable cartridges (containing consumable material to be vaporized) and power sources. A common coupling type (e.g., a 510 thread [10 threads at 0.5 mm per thread], an eGo thread, a 601 thread, etc.) allows cartridges, from a variety of manufacturers to be coupled to different models or types of power sources from various manufacturers of the same coupling type. Therefore, a user can attach a desired cartridge to a desired power source (e.g., dab pen, vape pen, vape battery, battery, etc.) through a common coupling type. However, such connections may only allow a cartridge to be attached to multiple power sources if the cartridge is independent from the power source, or "modular."

Generally, a device and method for vaporizing a consumable as presented herein includes a straw and a heating element configured to be connected to a desired power source type (e.g., vape pen, dab pen, battery, vape battery etc.). However, the device could also comprise a straw alone and the straw may be configured to receive a heating element. Either way, the heating element is configured to heat and vaporize a consumable. The vapor from the heated consumable may be syphoned through the straw and the straw may guide a flow of vapor to avoid the power source. That is, the power source is separated from the flow of vapor product and air. Thus, the flow of vapor product and air bypasses the power source. Moreover, the vaporization device (e.g., a nectar collector, dab straw, etc.) may be modular and, thus, may be connectable to different types of the power sources.

Figure 1A:
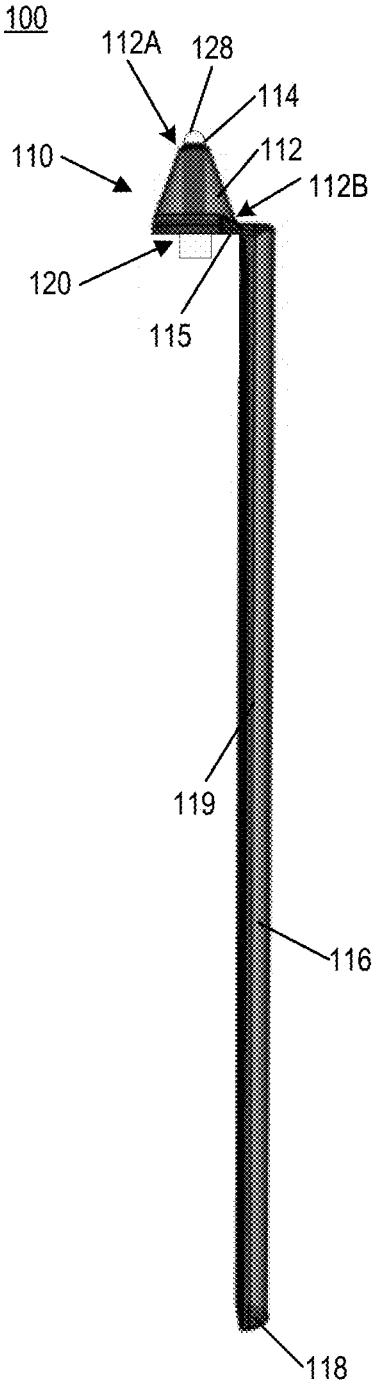
FIG. 1A is a side view of a nectar collector, according to an exemplary embodiment.
Figure 1B:
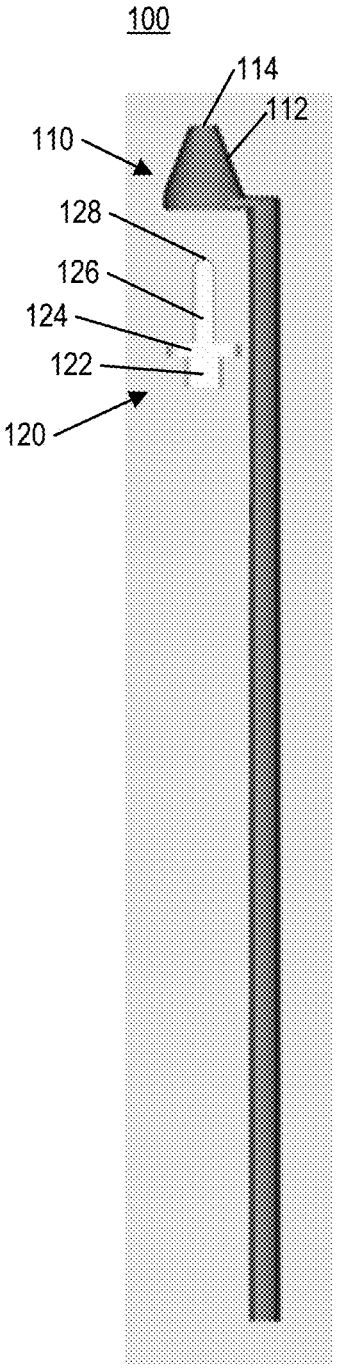
FIG. 1B is an exploded side view of the nectar collector of FIG. 1A.
Figure 1C:
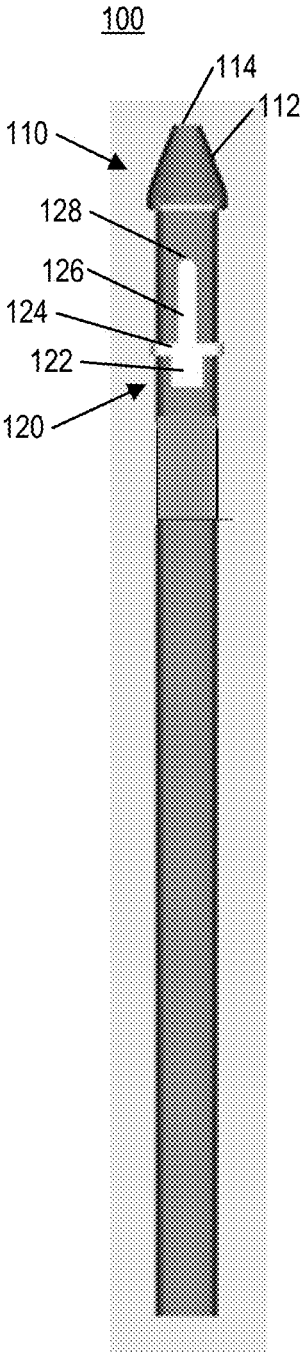
FIG. 1C is an exploded front view of the nectar collector of FIG. 1A.
Figure 2A:
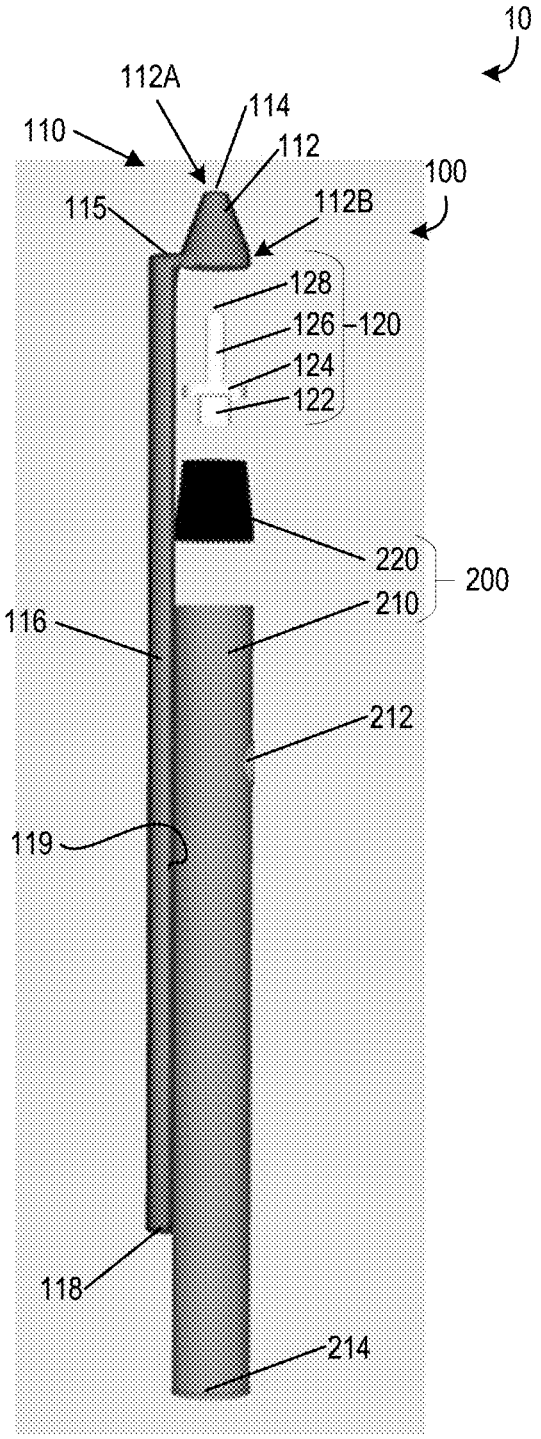
FIG. 2A is an exploded side view of a system including the nectar collector of FIG. 1A and a power source according to an exemplary embodiment.
Figure 2B:
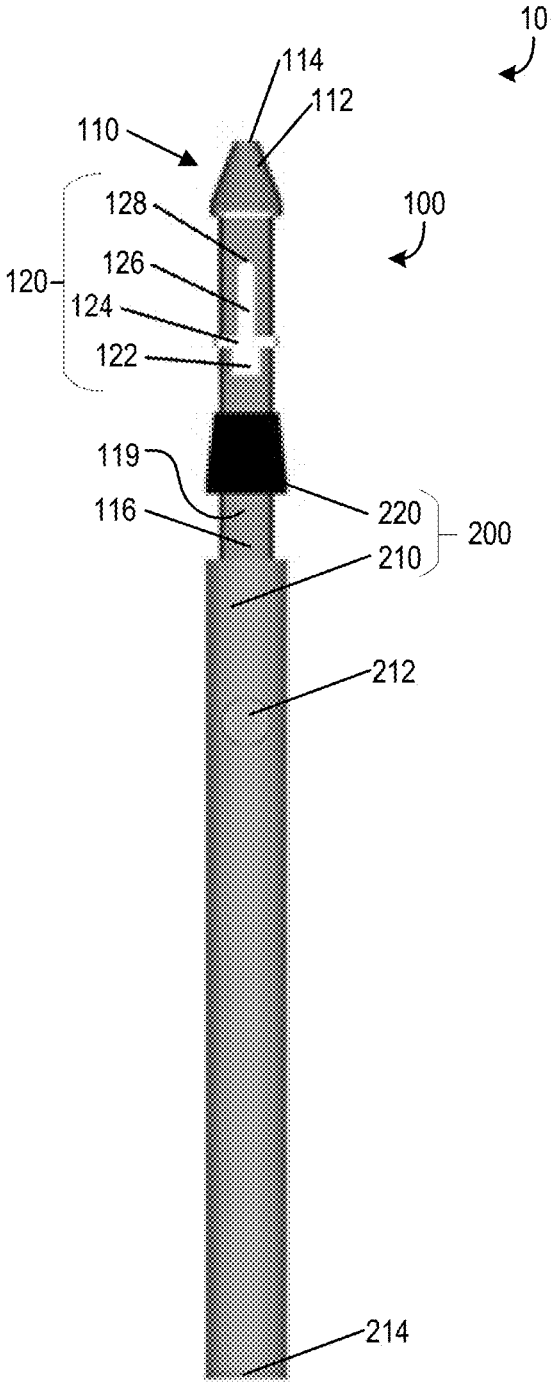
FIG. 2B is an exploded front view of the system of FIG. 2A.

Referring to FIGS. 1A-1C, a nectar collector 100 is shown. In the depicted embodiment, the nectar collector 100 includes a straw 110 and heating element 120. However, in other embodiments, a nectar collector may be comprised of only a straw 110. Either way, the straw 110 includes a frustoconical inlet 112 having an inlet port 114, a vapor tube 116, and an outlet port 118 distal to the inlet port 114. The vapor tube 116 is fluidly coupled to the inlet 112 via a connector duct 115. The connector duct 115 extends perpendicularly to the vapor tube 116, or at least to a major dimension of the vapor tube 116 (e.g., the primary direction in which the vapor tube 116 extends).

The inlet port 114 is fluidly coupled to the outlet port 118 via the inlet 112, connector duct 115, and vapor tube 116. That is, a sidewall of the inlet 112 defines a frustoconical cavity that is fluidly coupled to the vapor tube 116 via the connector duct 115. While the straw 110 is shown with a connector duct 115 fluidly coupling the cavity of the inlet 112 to the vapor tube 116, embodiments are not limited thereto. In some implementations, the cavity of the inlet 112 may be directly coupled to the vapor tube 116 without a connector duct 115.

The inlet 112 is configured to receive and partially encapsulate the heating element 120. That is, the inlet 112 is configured to at least partially surround the heating element, for example, enclosing the sides of the heating element while still allowing access to the heating element 120 (e.g., via an inlet port 114 configured as a top opening). More specifically, in the depicted embodiment, the heating element 120 includes a cylindrical base 122, a coil 124 electrically and/or thermally coupled to the base 122, and a rod 126 electrically and/or thermally coupled to the coil 124. The base 122 may be threaded to screw into a desired power source (e.g., a dab pen, vape pen, vape battery, battery, etc.). That is, the base 122 may be threaded to engage a common thread configuration of the power source, e.g., a 510 thread (10 threads at 0.5 mm per thread), an eGo thread, a 601 thread, etc. While various standard threads are disclosed, the base 122 may be sized and threaded to correspond to any desired coupling of any desired power source.

In the depicted embodiment, the coil 124 is disposed between the base 122 and rod 126 and is configured to heat the rod 126, or at least an outer surface of rod heating 126. A radius of the coil 124 is greater than a radius of the base 122 while a radius of the rod 126 is less than the radius of the base 122 and the radius of the coil 124. The rod 126 extends from the coil 124 opposite the base 122. A distal end 128 of the rod 126 is rounded. However, the base 122, coil 124, and rod 126 may have any desired size and shape, e.g., to conform to a variety power source. Moreover, in other embodiments, the heating element need not include a rod 126 and can include an elongate coil 124 that extends to a distal end of the heating element.

Moreover, the base 122, coil 124, and rod 126 may be ceramic, metal, or a combination of ceramic and metal and/or may be formed from one or more wire sizes. The coil 124 may also be positioned in any desired orientation or configuration within the heating element. For example, although the Figures show a coil 124 that is concentric with a rod 126, the coil need not be oriented in such a position and could, for example, be re-oriented to a position that is 90 degrees offset from the depicted position (i.e., rotated about its x- or z-axis, as opposed to being spun around its y-axis, so that the coil extends perpendicularly to a main direction of airflow into the heating element). Thus, rod 126 is merely an example and in other embodiments, the coil 124 may be exposed and directly contact a consumable substance and/or heat an outer surface of the heating element, which may take any form and may or may not be described as a rod. For example, the coil 124 may extend beyond a tapered outer surface and be configured to directly contact a consumable substance, an example of which is described below in connection with FIGS. 4A-4C.

As a specific example of a coil, the coil 124 may be a Clapton coil, which includes a thinner gauge wire tightly wrapped around a thicker gauge core. Typically, Clapton coils have a slower ramp-up (i.e., heat slower) than other coil types, but the texture and increased surface area of Clapton coils may provide enhanced heat retention, absorption, and flavor as compared to standard coils. Clapton coils may also be nearly self-cleaning. Since the coil 124 included in embodiments presented herein is at least partially exposed and can come into contact with vaporizable substance, the aforementioned characteristics (enhanced heat retention, absorption, and flavor) may make a Clapton coil particularly useful for use as coil 124.

In some embodiments, the heating element 120 is fixedly or irremovably secured to the straw 110. That is, the heating element 120 and straw 110 may be a single unit. However, in other embodiments, the heating element 120 may be removably coupled to the straw 110.

Referring to FIGS. 2A-3C, a system 10 comprising the nectar collector 100 and a power source 200 are shown. The power source 200 includes a main body 210 and a coupling head 220. The coupling head 220 includes a threaded opening (not shown). The main body 210 may include a battery. The main body 210 includes a button 212 for activating the power source 200. For example, when activated, the power source 200 may transmit a current to or heat the threaded opening of the coupling head 220. The power source 200 may be configured to engage a vape cartridge.

The nectar collector 100 is configured to be electrically and/or thermally coupled to the coupling head 220 of the power source 200, fixedly or removably. For example, the base 122 of the heating element 120 may be configured to engage the threaded opening of the coupling head 220. When the power source 200 is activated, power may be transmitted from the power source 200 through the coupling head 220 through the base 122 to the coil 124. The coil 124 may be configured to generate heat in response to receiving the power and may heat the rod 126. That is, the power source 200 may induce an electric current in the coil 124 when the heating element 120 is electrically coupled to the activated power source 200. In some implementations, the power source 200 may generate heat that is transferred to the heating element 120 when the heating element is thermally coupled to the activated power source 200.

The straw 110 may be configured to surround the heating element 120 and engage the power source 200. For example, the inlet 112 includes a cavity defined by a sidewall that surrounds at least a portion of the heating element 120 and the sidewall of the inlet 112 engages the coupling head 220 of the power source 200. That is, the inlet 112, or at least an inner surface of the inlet 112, is concentric with the heating element 120. In some implementations, an inner surface of the sidewall of the inlet 112 may couple to an outer surface of the coupling head 220 via a snap fit, interference fit, magnetic coupling, and/or threaded coupling. In some implementations, an inner surface of the sidewall of the inlet 112 may couple to an outer surface of the heating element 120, and the straw 110 may in turn be coupled to the power source 200 via the coupling between the heating element 120 and the coupling head 220. The coupling between the inlet 112 and the heating element 120 may be a snap fit, interference fit, magnetic coupling and/or threaded coupling.

In some implementations, the straw 110 may be configured to conform to the heating element 120 and a desired power source 200. For example, the inlet 112 may be configured to conform to the rod 126 and coil 124 of the heating element 120 and the coupling head 220. Meanwhile, the vapor tube 116 may be configured to conform to the main body 210 of a desired power source 200. For example, the inlet 112 has a frustoconical shape wherein at least a portion of the inlet 112 substantially follows the contours of a circumference of the rod 126 at an upstream end 112A of the inlet 112, and at least another portion of the inlet 112 substantially follows the contours of a circumference of the coil 124 and the coupling head 220 at a downstream end 112B of the inlet 112. That is, a diameter of the inlet port 114 is larger than a diameter of the rod 126, and a diameter of the downstream end 112B is larger than a diameter of the coil 124. Consequently, radial gaps are formed between the inlet port 114 and the rod 126 and between the downstream end 112B and the coil 124. The radial gaps allow a flow of fluid (e.g., vapor) through the inlet 112 to the vapor tube 116. The radial gaps, or at least the radial gap between the rod 126 and the inlet port 114, may also allow a vaporizable substance to enter the straw 110 (e.g., via inlet 112).

Further, a lateral surface 119 of the vapor tube 116 is concave to conform to the main body 210 of the power source 200. The close conformity of the straw 110 to the heating element 120 and the power source 200 may maintain an alignment of the straw 110 with the power source 200. That is, the straw 110 may cradle the power source 200, and thus, prevent disassembly. Further, the vapor tube 116 may extend past a main body 210 of a desired power source 200 such that the outlet port 118 is disposed beyond a distal end 214 of the desired power source 200, opposite the coupling head 220. Consequently, a user may be able to place the outlet port 118 and a portion of the vapor tube 116 into their mouth without obstruction from the main body 210 of the power source 200.

Figure 3A:
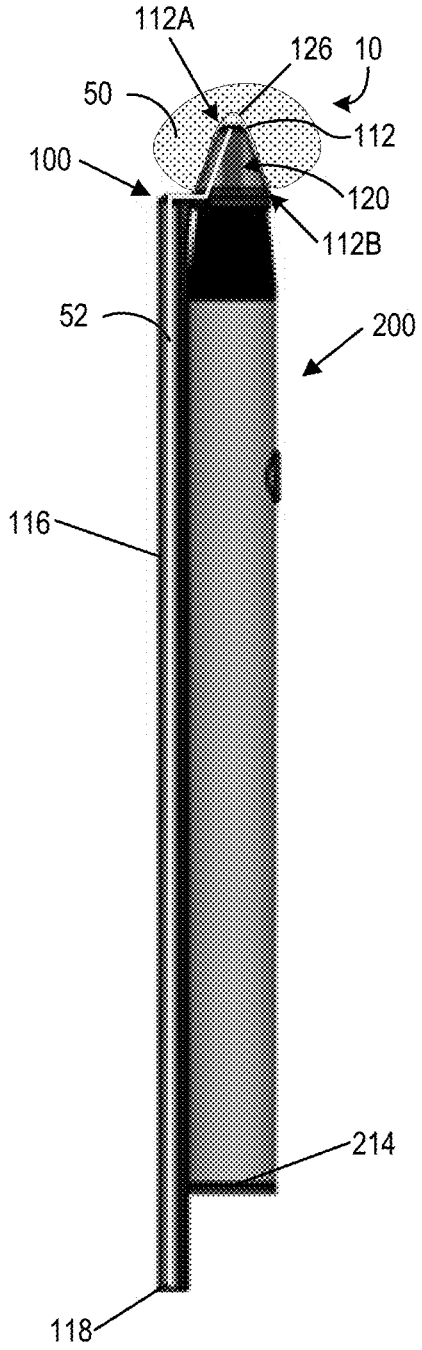
FIG. 3A is a side view of the system of FIG. 2A assembled, with the nectar collector of FIG. 1A attached to the power source of FIG. 2A.
Figure 3B:
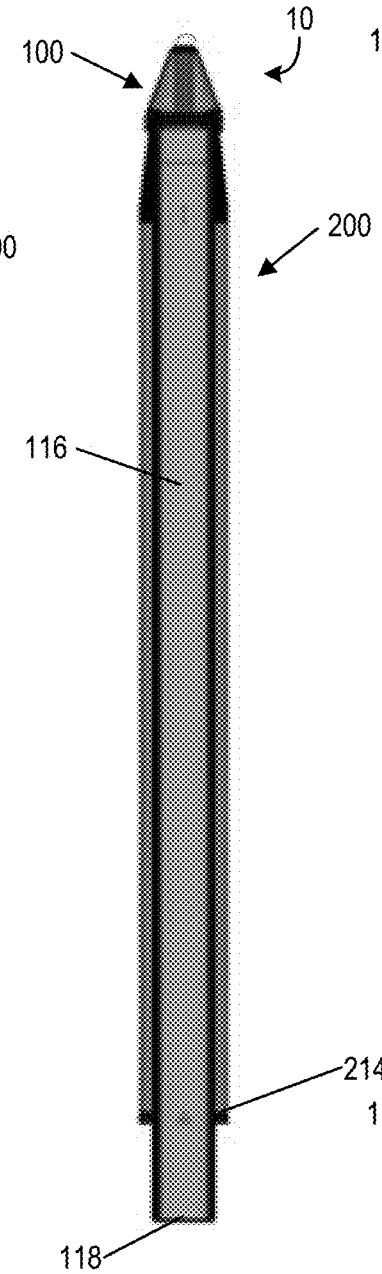
FIG. 3B is a rear view of the system of FIG. 3A.
Figure 3C:
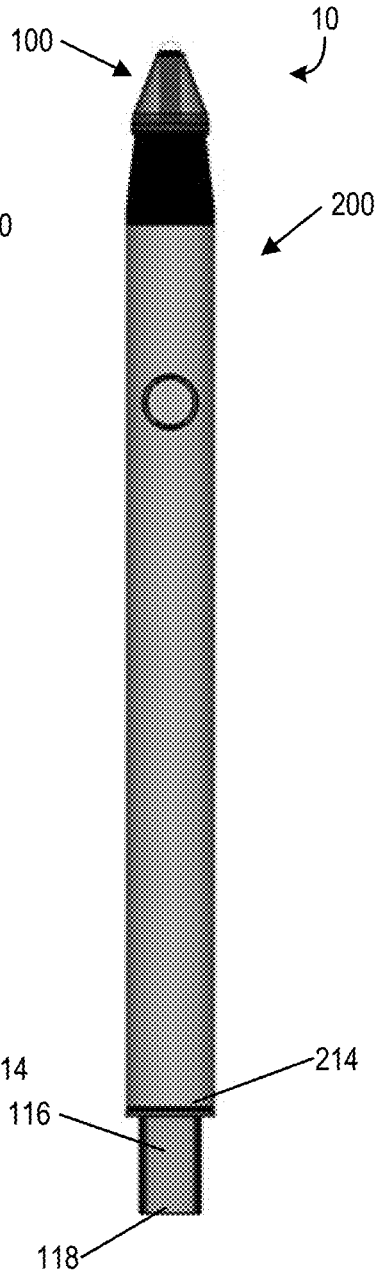
FIG. 3C is a front view of the system of FIG. 3A.

During operation, a consumable 50, e.g., wax, oil, etc., is applied to the heating element 120 and is vaporized in response to the heat from the activated heating element 120. For example, as depicted in FIG. 3A, the assembled nectar collector 100 and power source 200 are oriented so that the distal end 128 of the rod 126, protruding from the inlet port 114, contacts the consumable 50 (i.e., held upside-down). When the heated rod contacts the consumable 50, vapor products 52 form around the rod 126. Then, suction applied to the outlet port 118 syphons the vapor products 52 through the inlet 112 cavity, the connector duct 115, the vapor tube 116, and the outlet port 118 (i.e., suction causes vapor products 52 to flow through the straw 110). The vapor products flow around the power source 200. That is, the vapor products flow exteriorly of the main body 210 of the power source 200. Accordingly, the vapor flow does not cause or encourage clogging and corrosion of the power source 200.

Figure 4A:
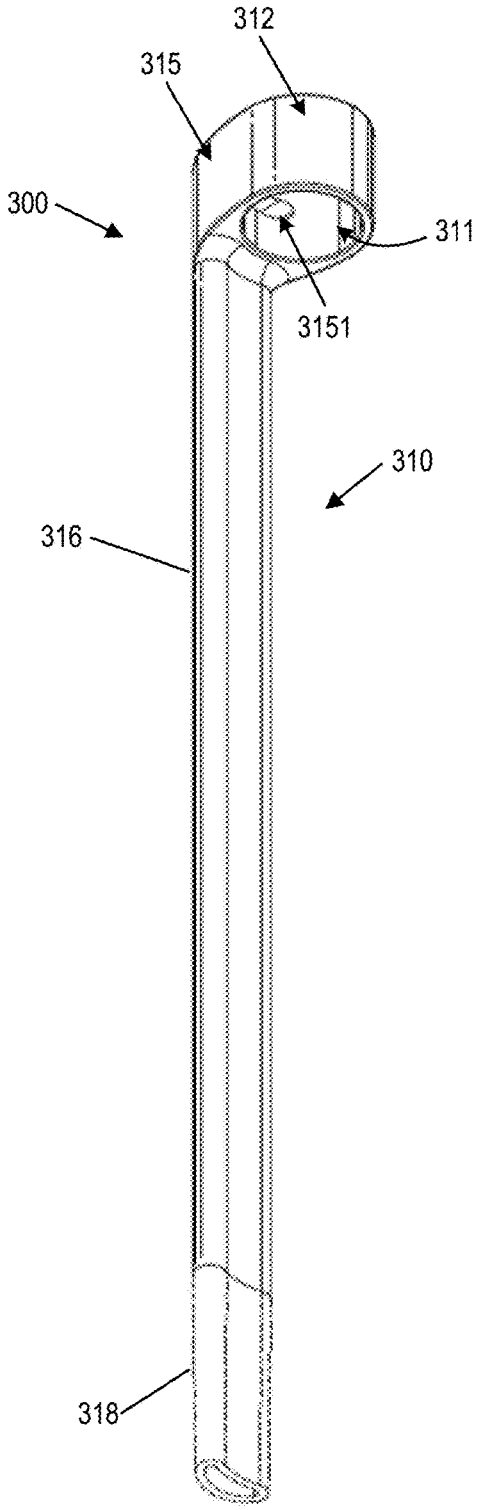
FIG. 4A is a bottom perspective view of a nectar collector, according to another exemplary embodiment.
Figure 4B:
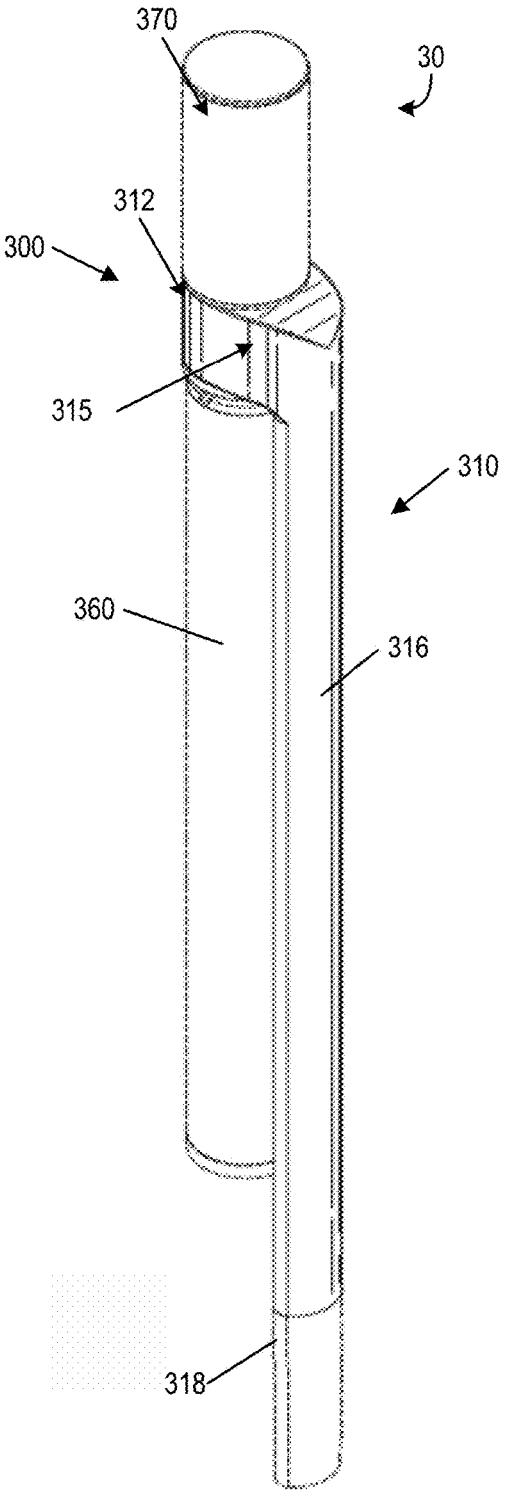
FIG. 4B is a top perspective view of a vaporization system including the nectar collector of FIG. 4A, according to another exemplary embodiment.
Figure 4C:
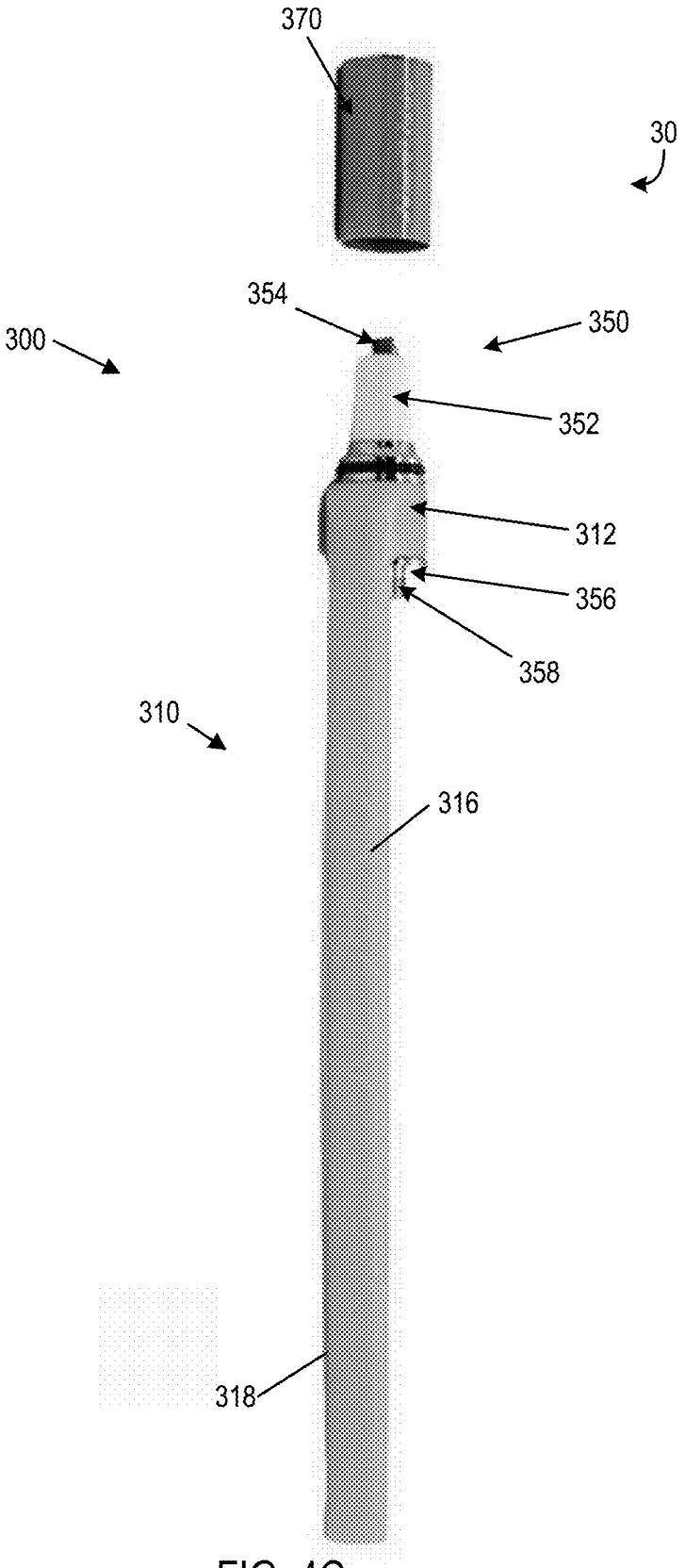
FIG. 4C is a side view of the vaporization system of FIG. 4B, but with a cover removed.

Now turning to FIGS. 4A-4C, another example embodiment of a nectar collector 300 is shown, both separately and as part of a vaporization system 30. The nectar collector 300 is similar to nectar collector 100 and any description of parts or functions of nectar collector 100 should be understood to apply to like parts of nectar collector 300. Thus, the foregoing description focuses on differences between nectar collector 100 and nectar collector 300. For example, nectar collector 300 includes a straw 310 that includes a vapor tube 316 that extends from an outlet 318 to an inlet 312, like nectar collector 100, but now, the inlet 312 is shaped as an annular cylinder that extends around a central cavity 311 configured to receive a heating element.

More specifically, inlet 312 is still configured to at least partially encapsulate a heating element 350 (see FIG. 4C), like the inlet 112 of straw 110, but now, the inlet 312 does not converge towards the heating element 350. Instead, as is shown clearly in FIG. 4A, the inlet 112 is substantially cylindrical. However, if desired, a heating element 350 disposed within the inlet 312 can coverage towards its top end (as shown in FIG. 4C).

Straw 310 is also similar to straw 110 in that the inlet 312 of straw 310 is fluidly coupled to the outlet port 318 via the a connector duct 315 and the vapor tube 316. However, now, a sidewall of the inlet 312 includes an opening 3151 that extends through connector duct 315 to fluidly couple inlet 312 to vapor tube 116. As can be seen in FIG. 4B, when nectar collector 300 is incorporated into a vaporization system 30, the connector duct 315 positions the vapor tube 316 to extend along a length of a power source 360 included in the system 30 (as is described in detail above in connection with nectar collector 100). A heating element 350 (see FIG. 4C) primarily extends in an opposite direction from the power source 360 and the heating element 350 can be selectively covered by a removable cover 370 (see FIG. 4B). The cover 370 may be removably secured to the nectar collector 300 via a deformable friction fit (e.g., created with a gasket or O-ring).

As can be seen in FIG. 4C, in the depicted embodiment, the heating element 350 includes a coil 354 and an outer casing 352. The outer casing 352 is tapered towards a top or distal end of the heating element 350 and the coil 354 protrudes beyond the top or distal end of the outer casing 352. Thus, the coil 354 may directly contact a consumable/vaporizable substance and control the flow of vapor towards the straw 310 (e.g., as drawn by suction).

More specifically, in the depicted embodiment, the outer casing 352 may define a chamber around and/or beneath the coil 354. Then, when a hot coil (heated with power from a power source connected thereto) contacts a consumable/vaporizable substance, vapors may collect in the chamber. The bottom of the chamber may be formed by a base 356 with a threaded stem 358 configured to connect the heating element 350 to a power source (e.g., a 510 threaded battery). The chamber also includes at least one side opening configured to align with the opening 3151. Thus, when the exposed portion of coil 354 heats a consumable/vaporizable substance, a pressure gradient, e.g., created by suction applied by a user at outlet 318, may draw vapor (generated by heating the substance) through coil 354, the chamber, the opening 3151, and into the straw 310. The outer casing 352 may be substantially frustoconical to define a chamber that widen from its top or distal end towards the base 356; however, this is only one example and, in other embodiments, the outer casing 352 may have any shape (or, if the straw forms a similar feature, like inlet 112, that corresponding feature may have any shape).

Figure 5:
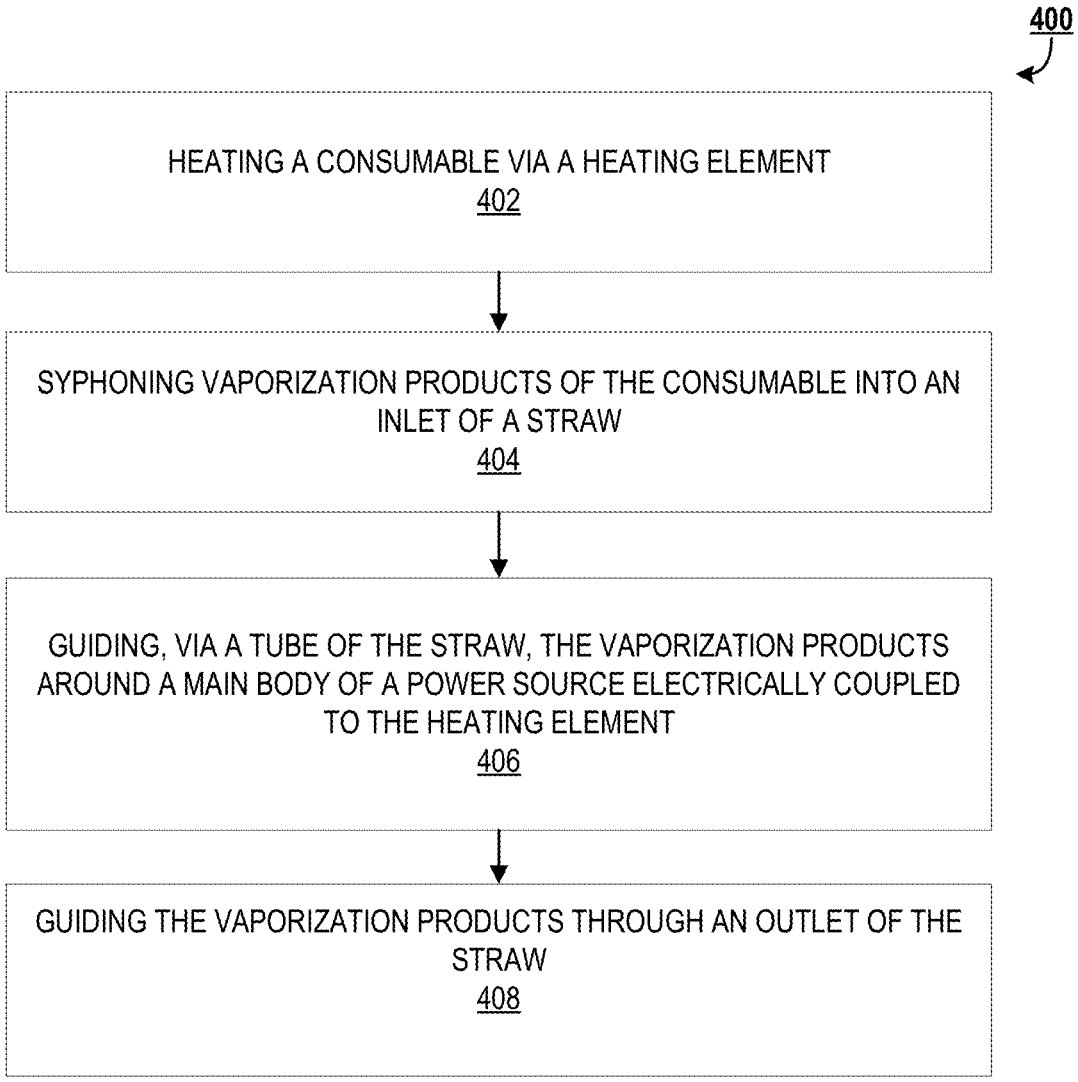
FIG. 5 is a flow diagram illustrating a method of generating and guiding a flow of vapor products through the nectar collector.

With reference to FIG. 5, a method 400 of generating and guiding/directing a flow of vapor products through the nectar collector is described. The method includes heating a consumable (e.g., a vaporizable substance) via a heating element in operation 402, and syphoning vaporization products (i.e., vapors) of the consumable into an inlet of a straw in operation 404. The method further includes guiding the vaporization products, via a tube of the straw, around a main body of a power source electrically coupled to the heating element in operation 406, and guiding the vaporization products through an outlet of the straw in operation 408.

In operation 402, heating the consumable may include directly contacting the consumable with a heated coil. Additionally or alternatively, the coil may heat another surface or component of heating element, such as the outer surface of a rod, which may be brought into contact with the consumable. Heating the coil or another surface or component of the heating element may further include transmitting electricity from the power source to the heating coil via a base extending from the heating coil.

In operation 404, the vaporization products may be siphoned into the inlet of the straw, through a connector duct, into the tube of the straw. The tube guides the vaporization products around the main body of the power source in operation 406. The tube then guides the vaporization products to the outlet of the straw where it may be inhaled by a user. Thus, no vaporization products flow through the main body of the power source, thus avoiding clogging or corrosion of the power source.

The nectar collector 100 described herein may be configured to attach to any power source (e.g., vape pen, dab pen, vape battery, battery) with a common coupling type. Thus, any desired power source may power the nectar collector 100.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the nectar collector system 10 described herein, or portions thereof may be fabricated from any suitable material or combination of materials, such as plastic, foamed plastic, wood, cardboard, pressed paper, metal, ceramics, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Finally, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Similarly, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

The invention claimed is:

1. A vaporization device comprising:

a heating element that is coupleable to a power source; and a straw having an inlet fluidly coupled to an outlet via a tube and a connector duct that extends perpendicularly to the tube, the connector duct fluidly coupling the inlet to the tube;

wherein the inlet is configured to partially encapsulate the heating element and the tube is configured to extend alongside the power source to which the heating element is coupled so that when the heating element heats a vaporizable substance, vapor generated by the heating element flows through the tube to the outlet alongside an outer surface the power source.

2. The vaporization device of claim 1, wherein the heating element comprises a coil and a portion of the inlet is substantially concentric with a circumference of the coil.

3. The vaporization device of claim 2, wherein the heating element further comprises a rod extending from the coil and at least a portion of the rod extends through an inlet port of the inlet.

4. The vaporization device of claim 2, wherein the heating element further comprises a base configured to couple the heating element to a coupling head of the power source.

5. The vaporization device of claim 4, wherein the inlet and the tube are configured to guide the vapor around the coil and the power source.

6. The vaporization device of claim 1, wherein the inlet comprises an annular, cylindrical portion.

7. The vaporization device of claim 1, wherein the inlet comprises a frustoconical portion with an inlet port, and the heating element comprises a rod extending from a coil, wherein the inlet port is concentric with a portion of the rod and the inlet port and the portion of the rod define a radial gap for guiding the vaporizable substance into the inlet.

8. The vaporization device of claim 1, wherein the tube comprises a concave lateral surface configured to conform to and contact the outer surface of the power source.

9. A vaporization system comprising:

a power source;

a heating element that is coupleable to the power source to receive power from the power source; and a straw having an inlet fluidly coupled to an outlet via a tube and a connector duct fluidly coupling the inlet to the tube, and the connector duct is perpendicular to the tube, wherein the inlet is configured to partially encapsulate the heating element and the tube is configured to extend alongside the power source when coupled thereto so that when the heating element heats a vaporizable substance, vapor generated by the heating element flows through the tube to the outlet alongside an outer surface the power source.

10. The vaporization system of claim 9, wherein the heating element comprises a coil and a portion of the inlet is substantially concentric with a circumference of the coil.

11. The vaporization system of claim 10, wherein the heating element further comprises a base configured to electrically couple the heating element to the power source.

12. The vaporization system of claim 10, wherein the heating element further comprises a rod and the inlet comprises an inlet port concentric with a portion of the rod, the inlet port and the portion of the rod define a radial gap for guiding the vaporizable substance into the inlet.

13. The vaporization system of claim 9, wherein the tube comprises a concave lateral surface that conforms to and contacts the outer surface of the power source.

14. A vaporization method comprising:

heating a consumable via a heating element;

syphoning vaporization products of the consumable into an inlet of a straw;

guiding the vaporization products from the inlet to a tube of the straw via a connector duct that extends perpendicularly to the tube;

guiding, via the tube, the vaporization products around a main body of a power source electrically coupled to the heating element; and guiding the vaporization products through an outlet of the straw.

15. The vaporization method of claim 14, wherein heating the consumable comprises contacting the consumable with a heating coil included in the heating element.

16. The vaporization method of claim 15, wherein heating the heating coil comprises transmitting electricity from the power source to the heating coil via a base extending from the heating coil.

17. The vaporization method of claim 14, wherein heating the consumable comprises contacting the consumable with a heated outer surface of the heating element.

* * * * *